US006786026B2

(12) United States Patent
Helmrich

(10) Patent No.: US 6,786,026 B2
(45) Date of Patent: Sep. 7, 2004

(54) STRAPPING MACHINE HAVING DIVISIBLE TAPE GUIDE FRAME

(75) Inventor: Lorenz Helmrich, Waldbrunn (DE)

(73) Assignee: Maschinenfabrik Gerd Mosca AG, Waldbrunn (DE)

( * ) Notice: Subject to any disclaimer, the term of this patent is extended or adjusted under 35 U.S.C. 154(b) by 0 days.

(21) Appl. No.: 10/102,998

(22) Filed: Mar. 21, 2002

(65) Prior Publication Data

US 2003/0025610 A1 Feb. 6, 2003

(30) Foreign Application Priority Data

Mar. 22, 2001 (DE) ..... 101 13 938
May 17, 2001 (DE) ..... 101 23 988

(51) Int. Cl.[7] ..... B65B 13/14

(52) U.S. Cl. ..... 53/589; 53/582; 53/399; 100/25; 100/26

(58) Field of Search ..... 53/589, 582, 399; 100/25, 26, 4, 27

(56) References Cited

U.S. PATENT DOCUMENTS 2,387,658 A 10/1945 Gruber et al.
2,742,851 A * 4/1956 Fryer ..... 100/4
3,234,870 A * 2/1966 Missioux ..... 100/26
3,557,684 A * 1/1971 Glasson ..... 100/26
6,003,438 A * 12/1999 Schwede ..... 53/589

FOREIGN PATENT DOCUMENTS

| | | |
|---|---|---|
| DE | 4237437 A1 * | 5/1994 |
| EP | 0 596 303 B1 | 8/1996 |
| FR | 2 306 882 | 11/1976 |
| FR | 2 780 702 | 7/1998 |
| WO | 92/02417 | 2/1992 |
| WO | 95/12525 | 5/1995 |

* cited by examiner

*Primary Examiner*—Stephen F. Gerrity
*Assistant Examiner*—Thanh Truong
(74) *Attorney, Agent, or Firm*—Choate, Hall & Stewart

(57) ABSTRACT

Described is a device for strapping packages having a tape supply for a tape-like strapping means, a tape guide channel for passage of the strapping means and a sealing unit for sealing the loop formed by the strapping means and surrounding the package, the tape guide channel being arranged on a frame that consists of two curved frame parts, which are movable out of a rest position below a supporting surface for the packages into a closed position above the supporting surface and back. Such an arrangement simplifies the drive and the guide for the frame parts. This is achieved since each of the two frame parts is guided moveably along its curved centerline below the supporting surface by at least one guiding device.

30 Claims, 7 Drawing Sheets

STRAPPING MACHINE HAVING DIVISIBLE TAPE GUIDE FRAME

BACKGROUND OF THE INVENTION

1. Field of the Invention

The present application relates to a device for strapping packages.

2. Description of Related Art

In strapping machines, a package is placed on the supporting surface of a supporting table so that, in the closed position of the frame parts, it is surrounded by this frame. The tape-like strapping means, briefly called strapping tape, which has been drawn from a supply reel and is accommodated in a tape storage, is supplied via a tape drive at high speed to the tape guide channel, so that it follows the course of the channel around the package. The tape is then drawn out of the tape guide channel and tightened around the package by a tensioning drive. The loop, tightly surrounding the package, is severed from the tape supply, and the two ends of the strapping tape are joined together. According to the related art, this is done by welding, in particular by friction welding.

Such devices are known from French Patent Application 2 306 882 and European Patent 0 596 303 B1.

French Patent Application 2 306 882 describes a strapping machine having a pivoting tape guide frame divided in the center. The tape guide channel is divided into two essentially semicircular segments, which are accommodated in two frame parts and are pivotable around a pivot axis. The piston rod of a pressure cylinder acts at some distance from the pivot axis of each frame part. This pressure cylinder allows each frame part to be pivoted from a rest position, in which it is pivoted below the supporting surface for the package, into a closed position. In the closed position both frame parts are located above the supporting surface for the package. The faces of the two frame parts are in contact with one another above the package, so that a closed, essentially circular ring-shaped tape guide channel is formed. The fact that the two frame parts that form the tape guide channel can be pivoted completely below the supporting surface for the package makes it possible to move bulky or long packages in any direction on the supporting surface before or after they are wrapped with a strapping means guided through the tape guide channel. The disadvantage of this arrangement lies in that the two frame parts pivot away laterally from the supporting surface for the package. Therefore sufficient space for the two frame parts to pivot in must be available in the strapping machine. This considerably increases the size of the strapping machine, as well as the space required for it.

Another arrangement of a strapping machine is disclosed in European Patent 0 596 303 B1. Here the two frame parts are movable out of the closed position, in which they surround the package above the supporting surface, into an open position below the supporting surface, without thereby being pivoted laterally. In the closed position, the tape guide channel formed by the two frame parts is located in the strapping plane, in which the strapping tape is carried around the package. When the frame parts are lowered, they are moved downward in the vertical direction by a complex lever system, essentially translationally, and at the same time are pivoted by a specified angle, so that they open like pincers, in order to be able to be moved past the package when they are lowered. To avoid collision of the two frame parts with the machine parts, particularly the sealing unit, located in the strapping plane below the supporting surface, the frame parts are displaced transversely relative to the strapping plane in such a way that they find their rest position parallel to and alongside the machine parts located in the strapping plane. This extremely short transverse motion, necessary according to the above-mentioned document, results from the lever drive used here for the frame parts and the path of motion traversed by the frame parts. This path of motion runs along large areas below the supporting table, so that it may proceed only alongside the strapping plane with the machine parts, such as the sealing unit.

It is desirable to provide a strapping device of the said type in such a way that, for opening and closing of the frame parts, a simple drive and a simplified guide may be used for the frame parts.

BRIEF SUMMARY OF THE INVENTION

According to the present invention, a strapping machine may have each frame part below a supporting surface guided moveably along its curved centerline by at least one guiding device.

According further to the present invention, a strapping machine has a guide for each frame part below the supporting surface moveable along its curved centerline, so that the closing motion and the opening motion of the frame proceed according to completely novel kinematics as compared with the related art. The frame is not pivoted about a fixed pivot axis nor is it translationally and rotationally displaced by a lever mechanism. According to the present invention, seating of each frame part alone permits its longitudinal movement in the direction of the curved centerline. A curved part moveable along a curved line is able to move on its curved path about the strapping region of the strapping machine. In other words, after placement of the package on the supporting surface, on each side of the package a frame part moves around the package by motion along a curved path, until both frame parts in the closed position form a closed tape guide channel that surrounds the package. For opening, the frame parts are moved in the opposite direction, then being guided in the guiding device following the curved centerline until each frame part is completely located below the supporting surface.

In an illustrative embodiment of the strapping machine, each frame part is curved in the shape of an arc of a circle and forms essentially a segment of a circular ring. Each frame part preferably forms just under one-half of a closed circular ring, i.e., its centerline forms an arc of approximately 170° to 175°. Each frame part should have a tape guide channel that extends over one quarter of a circular ring (approximately 90°). Thus, a tape guide channel is arranged over approximately half the semicircular frame part. The other half of the semicircular frame part has no tape guide channel. This embodiment is advantageous especially when the two frame parts are arranged in two planes displaced with respect to one another and the portions of the tape guide channel lie on the faces of the frame parts turned toward each other, so that both portions of the tape guide channel lie in essentially the same vertical plane. For closing the tape guide channel, the semicircular frame parts must be moved 90° in opposite directions around the center of the closed frame parts. In this closed position, the faces of the portions of the tape guide channel lie against one another, so that they form a closed tape guide channel. For opening the tape guide channel, the frame parts are again moved 90° in opposite directions around the center of the closed frame. In the rest position, the two semicircular frame parts lie essentially alongside one another below the supporting surface. The portion of the tape guide channel being fastened to the first frame part extending over 90° of the arc of the circular ring of this first frame part lies in the section of the second frame part having no tape guide channel and vice versa.

The guiding device for the frame parts according to the present invention may be designed in an extremely simple manner. It should consist of at least two guide rollers that lie against the first and against the second curved surface of the frame part. There the guide rollers may at the same time be designed as drive rollers and be connected with a drive motor, in particular an electric motor. In a preferred embodiment, a separate drive roller, which lies against one of the curved surfaces of the frame part, is provided in addition to the guide rollers. The drive roller alternatively may act against a non-curved surface of the frame part. Preferably, each frame part is guided in two guide-roller pairs, which at positions facing one another lie against the surfaces of the frame and are arranged close below the supporting surface on the one hand, and approximately at the center of the machine on the other hand. The two axes of the guide-roller pair near the supporting surface lie on a straight line slightly inclined with respect to the horizontal. The two axes of the rollers of the guide-roller pair in the center of the machine lie on a straight line that is inclined slightly toward the vertical. Thus, at both sides of its vertical center plane, the strapping machine in each instance comprises, for one frame part, two guide-roller pairs, which guide the frame part in the form of half a circular ring on two positions that are displaced with respect to one another by almost a quarter arc of a circle, referred to the center of the circular ring formed by the frame parts. These two guide roller pairs impart great stability to the two frame parts, while their arrangement in a machine housing may be implemented using a relatively simple design.

A drive roller, which rests against a surface of the frame part, advantageously is provided between the two guide-roller pairs that support a frame part. The drive roller advantageously rolls on the inner curved surface of the frame part. The drive roller preferably is driven by a controllable electric motor and acts via a friction coating on the surface of the frame part. The friction coating ensures that excessively high drive forces are not transmitted from the electric motor to the frame part. Depending on selection of the pressure force for the drive roller and the coefficient of friction between the friction coating of the drive roller and the frame part, the drive force for the frame part should be limited so that no persons may be injured by the moving frame part.

In addition, in order to drive the frame parts, the controllable electric motor may step through different speeds. In particular, the drive speed may be reduced shortly before closing of the frame parts by mutual contact of their front faces. This prevents a person who reaches in between the closing frame parts from being injured by too high a closing speed of the frame parts.

An interlocking drive element, for example a gear wheel, which cooperates with a gear ring, may of course be used as an alternative to a friction roller. When the drive force is to be limited here, too, a slip clutch may be provided between the drive element and the electric motor.

In an illustrative embodiment of the present invention, the tape guide channel is designed as a closed tape guide channel, i.e., in the closed state the tape guide channel is closed on all sides by essentially stationary walls. For this purpose, the portions of the tape guide channel are moveably fastened on the frame parts, so as to be moved transverse to their curved centerline, i.e., transverse to the vertical strapping plane. When the tape guide frames are closed, the two portions of the tape guide channel are shifted so that they lie in one plane. Each portion of the tape guide channel comprises a slot open on one side, which forms the recess for accommodation of the tape itself. The slot open on one side is closed off by the surface of the frame part against which the portion of the tape guide channel rests. After insertion of the strapping tape into the tape guide channel and before tightening of the strapping tape by the tensioning drive for the strapping tape, the tape guide channel is opened, in that the two portions are in each instance shifted in opposite directions transverse to the strapping plane by approximately the width of the strapping tape. At the same time the flat strapping tape, relatively rigid in its main plane, is arrested in its original position by the two parts of the frame, so that it emerges from the slot in the portion of the tape guide channel. Retraction of the strapping tape by the tensioning drive causes the formed tape loop to be tightened.

Before opening of the two frame parts that form the tape guide channel, the portions of the tape guide channel may again be moved toward the frame parts, so that they fit snugly. Transverse movement of the two portions of the tape guide channel relative to the respective frame parts to which the channel portions are fastened may be effected by any desired drive means, for example magnetic drives, pneumatic drives, control cams or lever drives.

The faces of the two parts of the frame with the tape guide channel preferably have centering means, which upon closing of the frame align the two portions of the tape guide channel to one another. Preferably, a conical bore is provided in one face of a part of the frame. A tapered pin is fastened on the face of the other part. Upon closing of the frame of the tape guide channel the faces of its two parts are moved toward one another. At the same time, the tapered pin penetrates into the conical bore. In the fully closed position the faces of the two parts of the frame are exactly aligned with one another, so that no difference in level that might hinder rapid feed and passage of the strapping tape occurs in the tape guide channel.

In order to ensure reliable operation of the strapping machine according to the present invention, a sensor preferably is provided for detection of the closed position of the two frame parts. Feed of the strapping tape is released only in the closed position. Should the frame that forms the tape guide channel be prevented from closing completely in its path of motion, either by the package or by some other obstacle, tape feed is halted. This ensures that tape feed into the tape guide channel takes place only when the tape guide channel is properly closed.

In addition to the limitation of the driving force of the frame parts via a slip clutch, described above, it is likewise possible to increase personal safety via a sensor for determination of the driving force acting on the frame parts. Should the sensor measure too high a driving force, for example when a frame part strikes an obstacle before the closed position, the power supply to the drive device for the frame parts may be interrupted.

An embodiment of the strapping machine may have two semicircular frame parts in two different planes, where the portions of the tape guide channel on the faces of the frame parts facing one another are arranged in essentially the same plane, preferably is fastened to a supporting frame that has the cross section of an upside-down "U." The supporting frame consists of two vertical cheeks facing one another and a bearing surface running between these cheeks. The machine parts of the strapping machine, in particular the sealing unit, the tape drive and the guide elements that introduce the tape delivered from the tape storage near the supporting surface into the tape guide channel, as well as the tensioning drive, are arranged on the bearing surface.

A frame part for formation of the tape guide channel is preferably fastened to each cheek of the supporting frame. For this purpose the cheek supports the two guide-roller pairs as well as the drive motor with the drive roller for the respective frame part. Preferably, identical structural parts are used for the two cheeks, and identical guide-roller pairs and drive motors for the two frame parts may likewise be used. In this way, the number of parts that have to be fabricated for production of the strapping machine is considerably reduced.

The surfaces of the frame parts as well as the rollers rolling on them are preferably designed arched in complementary fashion, so that the frame parts are stabilized in the transverse direction by the rollers fastened to the supporting frame of the machine.

Individual features of the present invention may of course be varied without departing from the scope of the disclosure and the claims. Thus, it is not absolutely necessary that the frame parts have an exactly annular segment-like shape. The curvature may alternatively differ from a circular curvature, while it must be noted that unbalanced forces are observed during closing and opening of the frame parts. The guiding devices for the frame parts must be designed appropriately strengthened. In the case of frame parts that are not exactly circular in shape, it will as a rule also be necessary to fasten individual guide rollers moveably, e.g., pretensioned by a spring force, to the supporting frame of the machine, since the surface sections which rest against the guide rollers will lie at the same position only during motion of a circular frame part.

BRIEF DESCRIPTION OF THE DRAWINGS

An embodiment of the present invention will be described below with reference to the accompanying drawing, wherein.

DETAILED DESCRIPTION OF THE INVENTION

Figure 1:
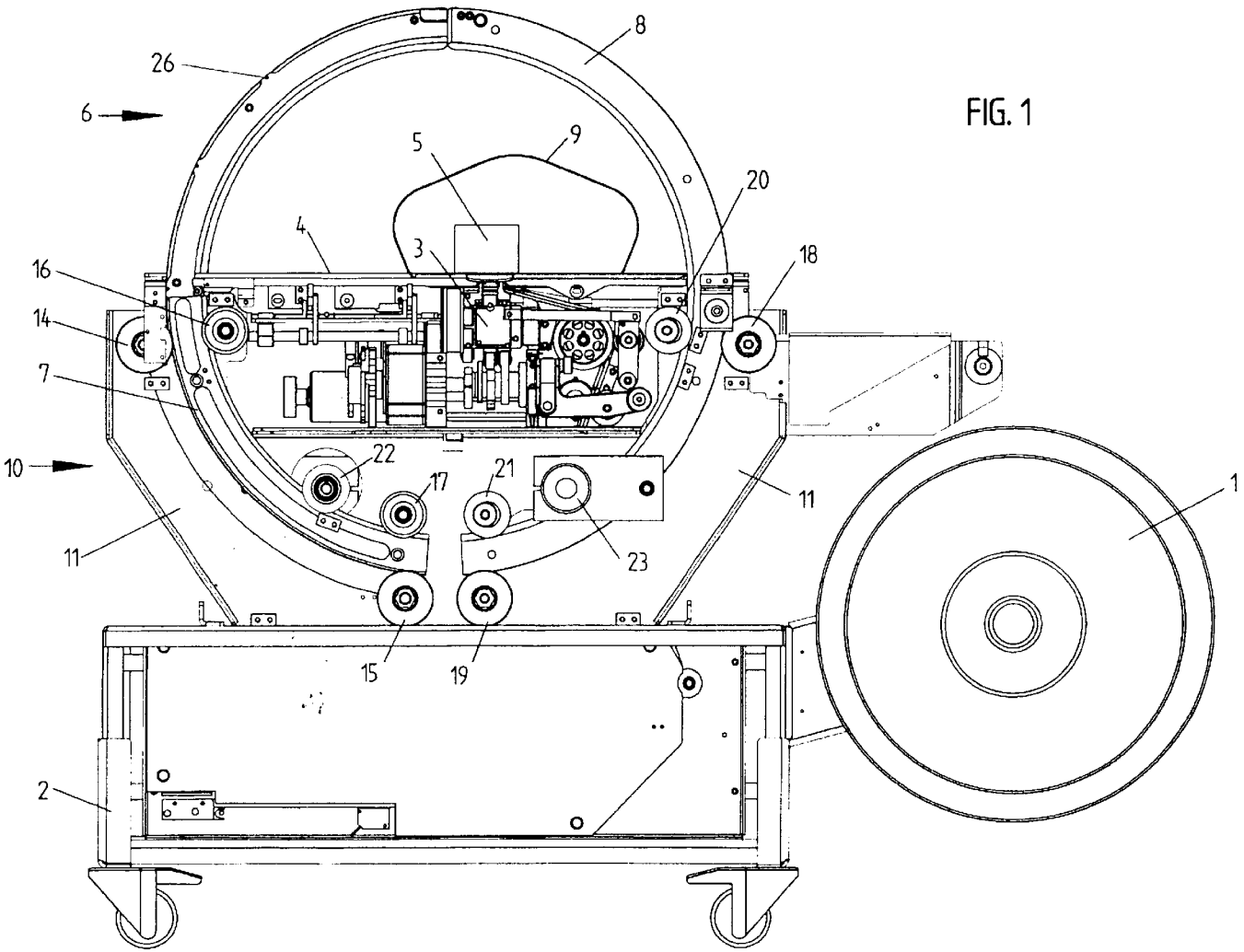
FIG. 1 shows a side view of a strapping machine according to the present invention with closed tape guide frame.

The strapping machine shown in the accompanying drawings has a supply reel 1 for the strapping tape. The strapping tape as a rule consists of a flat band of synthetic material 5 to 15 mm in width and less than 1 mm thick. The strapping tape is drawn from supply reel 1 and supplied to a tape storage in the region of machine stand 2 of the strapping machine. The tape is transported from the tape storage upward into the region of tape guide frame 6 and sealing unit 3. The forward feed of the tape takes place there in known fashion via transport rollers. Tightening likewise takes place via tension rollers, which are known from the related art and need not be described in detail in connection with the present invention. In the region of a supporting surface 4, on which a package 5 may be placed, the tape is supplied to the tape guide channel of tape guide frame 6, which is formed by two frame parts 7, 8. A loop formed by the strapping tape is represented in some of the figures and is identified by reference numeral 9. Package 5 is represented only symbolically as an elongated part with a rectangular cross section.

Supporting surface 4 for package 5 may be formed by a supporting table, which covers sealing unit 3 at the top. Supporting table 4 only has openings for passage of the two frame parts 7, 8 of tape guide frame 6, as well as, preferably in the center, a slot for passage of loop 9 of the strapping tape. For reasons of clarity, the supporting table, as well as the housing surrounding the strapping machine, is not represented in the accompanying drawing.

The tape guide channel of the device according to the present invention is formed by frame 6, consisting of two frame parts 7, 8. It may be moved from the closed position represented in FIGS. 1, 3 and 6 into the open position below supporting surface 4, represented in FIG. 2. In the closed position, tape guide frame 6 forms a semicircle above supporting surface 4. A closed semicircular tape guide channel is defined by this tape guide frame 6.

Figure 2:
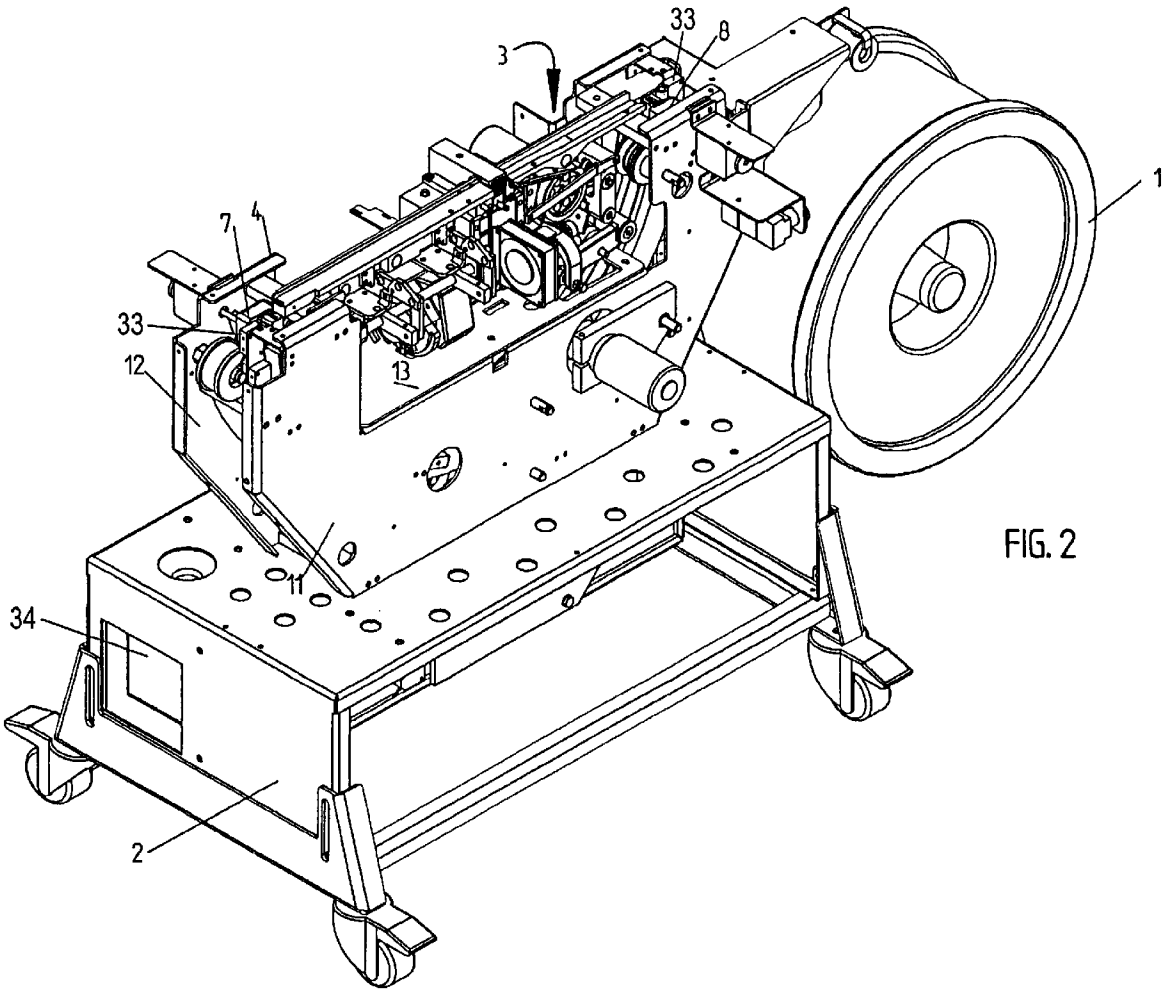
FIG. 2 shows a diagrammatic view of the machine in FIG. 1 with open tape guide frame.

In FIG. 2 the two frame parts 7, 8 are shown in the rest position, in which they lie completely below supporting surface 4 for the package.

Figure 4:
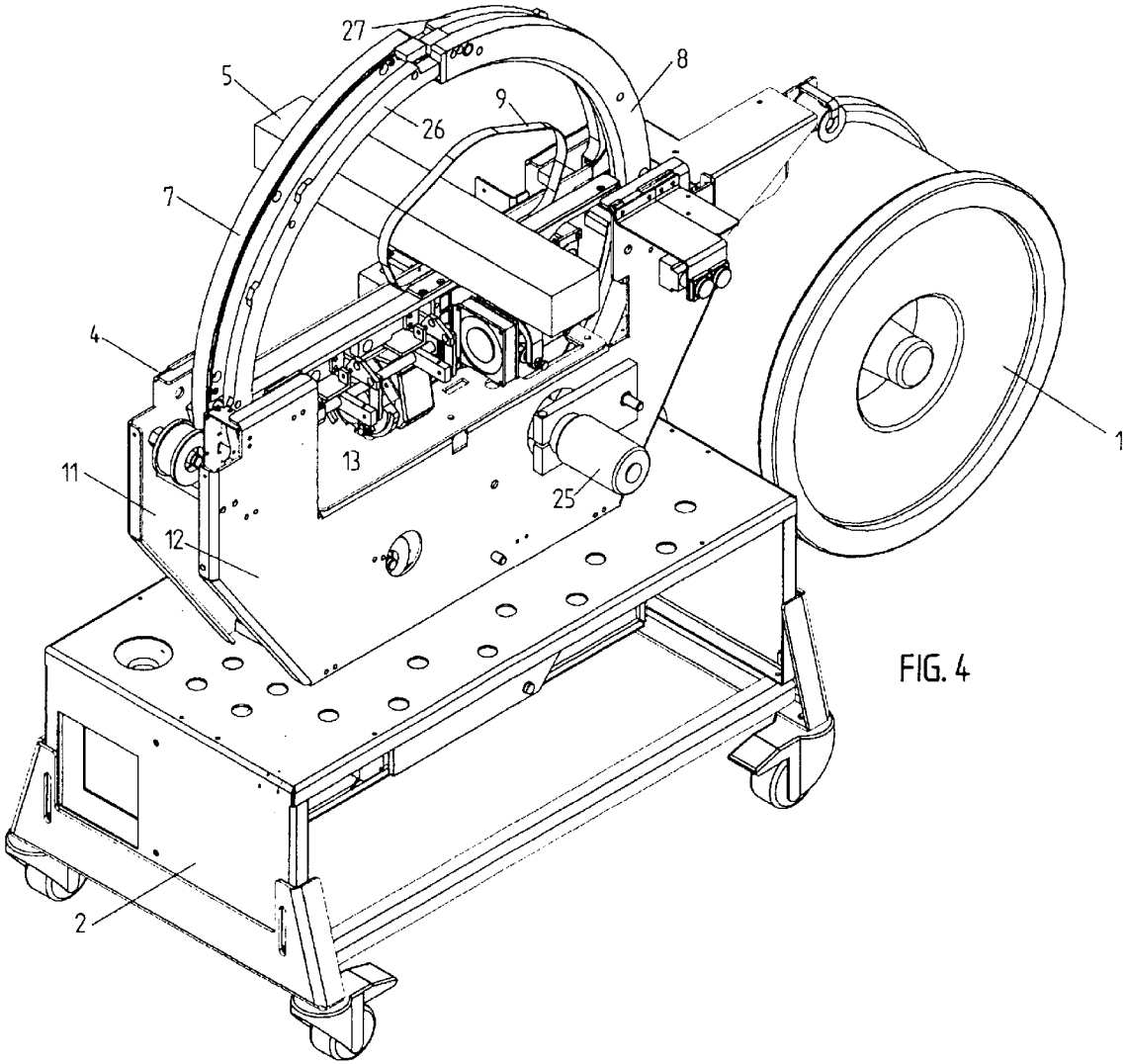
FIG. 4 shows a representation corresponding to FIG. 3 with open tape guide channel at closed tape guide frame.

Particularly in FIG. 1, it can be seen that the two frame parts 7, 8 of tape guide frame 6 are seated on a supporting frame 10 of the strapping machine. Supporting frame 10 is composed of two vertical cheeks 11, 12 (see FIG. 4), as well as an upper bearing surface 13. Bearing surface 13 extends between two cheeks 11, 12 and is essentially horizontal. The machine parts of the strapping machine, in particular parts of the tape drive and sealing unit 3, are arranged on bearing surface 13.

A frame part 7, 8 is fastened to each cheek 11, 12 of the supporting frame of the strapping machine. FIG. 1 shows an assembly drawing of all structural parts of the machine, cheek 12 being omitted. Thus the guide and the drive for frame parts 7, 8 are clearly visible. Frame part 7 is fastened to cheek 11. Cheek 11 bears two guide-roller pairs 14, 16 and 15, 17, each of which has an outer roller 14, 15 and an inner roller 16, 17. Outer rollers 14, 15 rest against the convexly arched outer side of annular frame part 7. Inner rollers 16, 17 rest against the concavely arched inner side of frame part 7. The guide rollers 14–17 are the guiding device for the frame part 7 of the strapping machine. Two guide-roller pairs 18, 20 and 19, 21, each consisting of an outer roller 18, 19 and an inner roller 20, 21, are also fastened to cheek 12, not represented in FIG. 1. These guide rollers 18 to 21 support the second frame part 8. The guide rollers 18–21 are the guiding device for the frame part 8 of the strapping machine. Guide rollers 14–17, guide rollers 18–21, frame parts 7, 8 and the guide channel formed by the frame parts collectively form a guiding unit of the strapping machine.

A drive roller 22, 23, which is driven by an electric motor 24, 25 (see FIG. 7), is arranged between each of the two guide-roller pairs on each cheek 11, 12. Each drive roller 22, 23 works as a friction roller, i.e., it is capable of transmitting driving forces up to a specified limit. When this limit is exceeded, the surface of the roller slips with respect to the surface of frame part 7, 8. In this way, the closing force of the two frame parts 7, 8 is limited. As shown in FIG. 2, sensors 33 detect a closed position of the frame parts 7, 8. Control device 34, arranged in the machine stand 2, releases a feed of the strapping tape when one or more of the sensors 33 emit a signal representing the closed position of the frame parts 7, 8.

Figure 5:
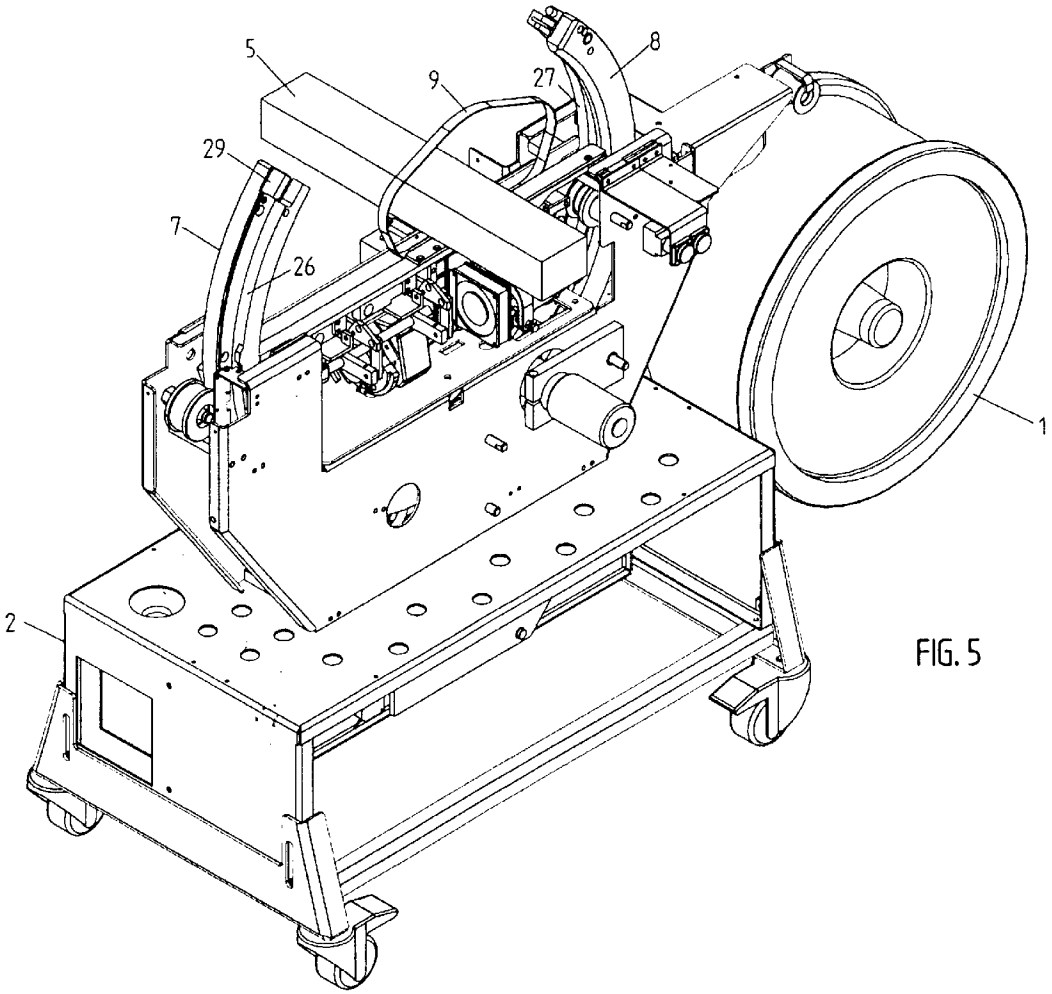
FIG. 5 shows a representation of the strapping machine corresponding to FIG. 4 with partially open tape guide frame.
Figure 6:
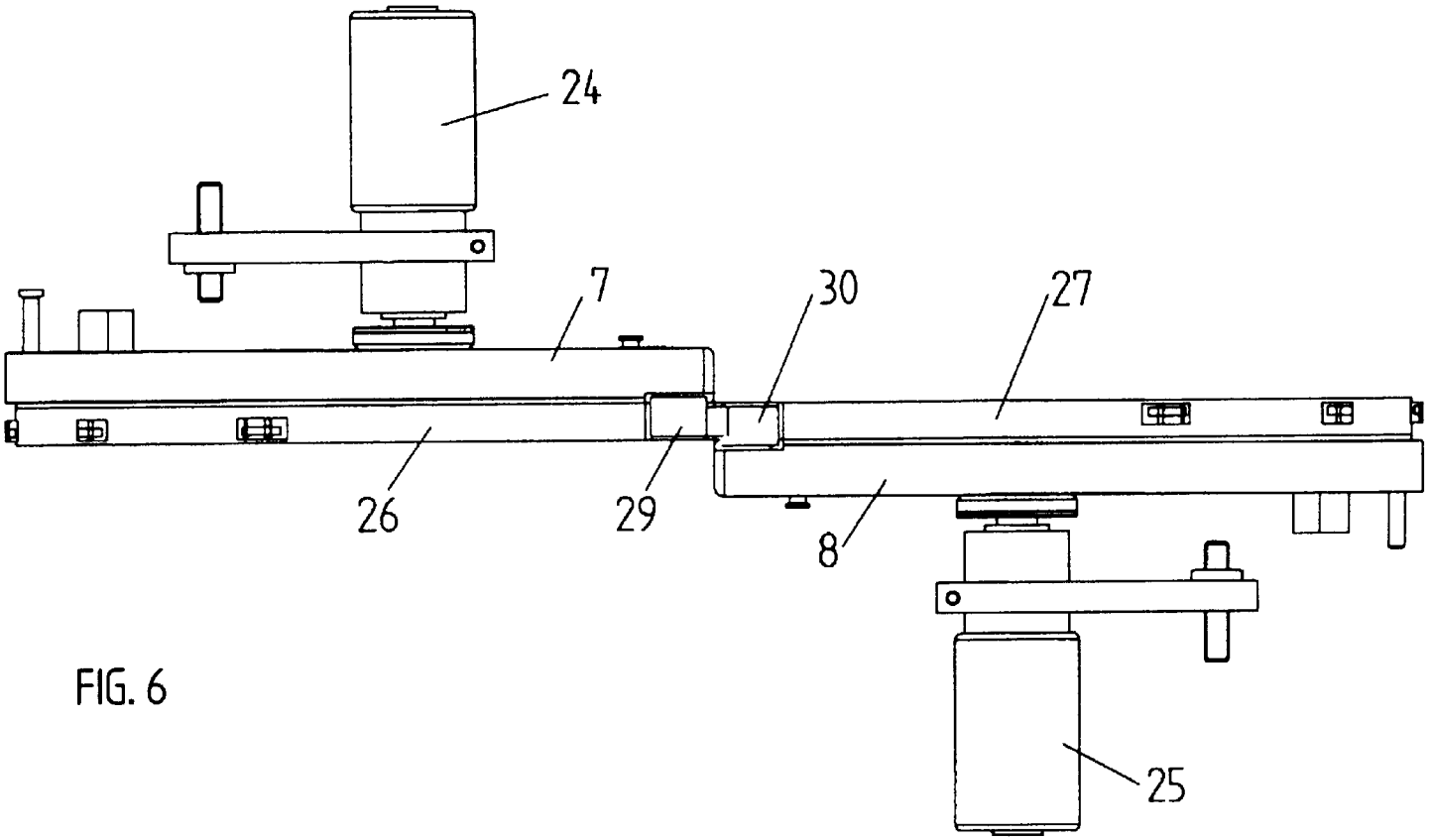
FIG. 6 shows a top view of the closed tape guide frame with closed tape guide channel.
Figure 7:
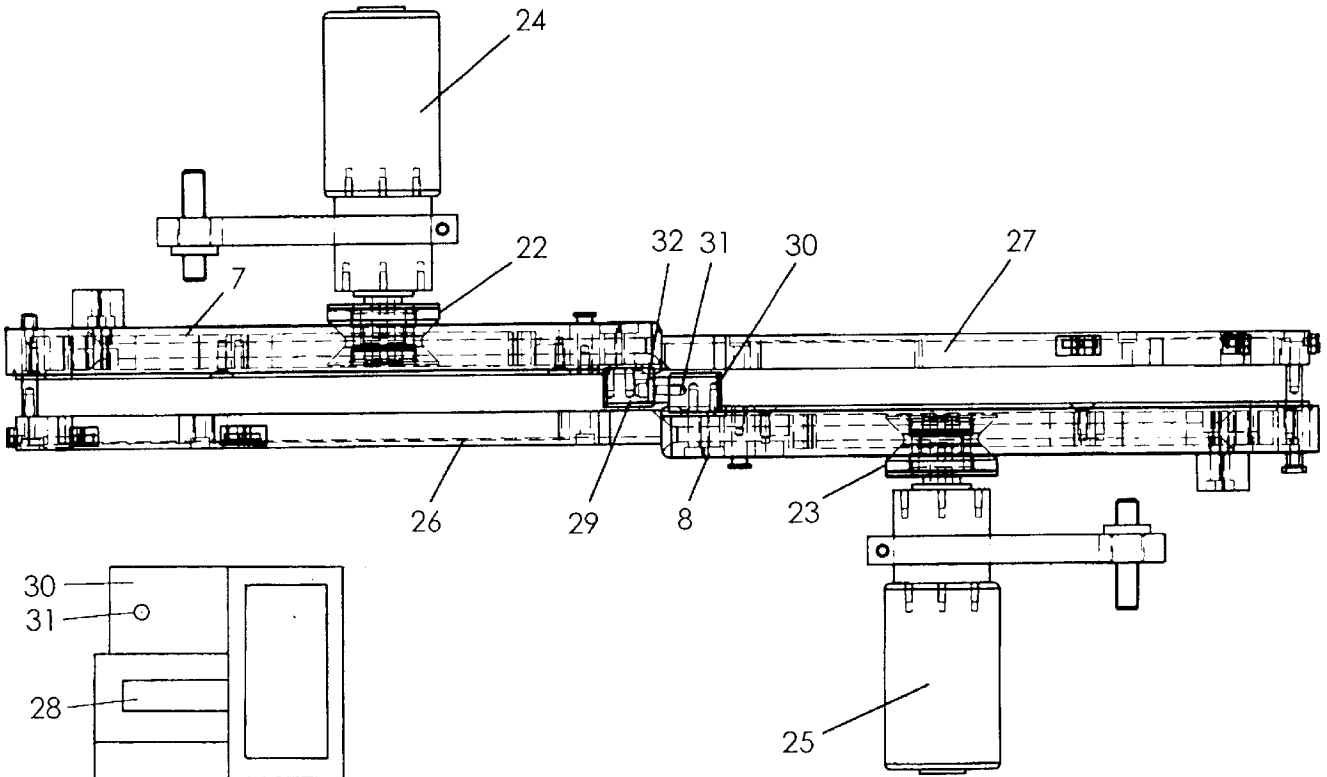
FIG. 7 shows a representation corresponding to FIG. 6 with open tape guide channel at closed tape guide frame.
Figure 8:
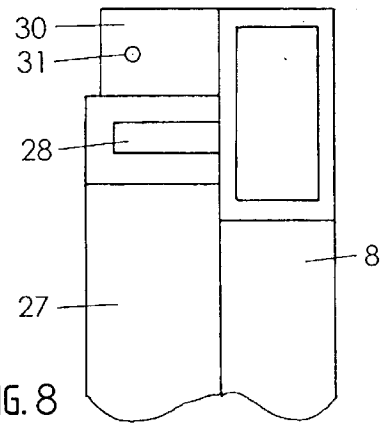
FIG. 8 shows a front view of the upper part of the frame part and of the portion of the tape guide channel.

The spatial arrangement of the semicircular frame parts 7, 8 is shown in FIGS. 6 and 7. Frame parts 7, 8 lie in two planes displaced with respect to one another, so that they may be moved out of the closed position shown in FIGS. 1 and 6 via any intermediate positions (see FIG. 5) into the open position shown in FIG. 2. A portion 26, 27 in the shape of one quarter of a circle is fastened to each of frame parts 7, 8 for formation of the tape guide channel. As can be seen especially in FIG. 3, each portion 26, 27 of the tape guide channel has essentially the shape of a segment of a circular ring covering approximately 90°. As can be seen especially in FIG. 5, portions 26, 27 have a slot in their center, which is open on the side of portion 26, 27 facing frame part 7 or 8.

As FIGS. 6 and 7 show, portions 26, 27, which have the slot for formation of the tape guide channel, are mounted moveably in the direction transverse to the strapping plane, with regard to frame parts 7, 8. When portions 26, 27 of FIG. 6 rest firmly against frame parts 7, 8, a closed tape guide channel is created. Motion of portions 26, 27 in the direction transverse to the strapping plane opens the tape guide channel of FIG. 7. A slot is produced between frame part 7 and 8 and portion 26 and 27 fastened to it, through which the strapping tape may leave the tape guide channel and be drawn around package 5. The use of such a closed tape guide channel has the advantage that strapping tapes of various widths may be inserted into the tape guide channel. In so-called open tape guide channels or in tape guide channels with pivotable flaps the risk exists that a thin tape may flutter upon insertion into the tape guide channel and, in the worst case, clog the channel. This risk is clearly reduced in the closed tape guide channel. The machine according to the present invention, with closed tape guide channel, may thus be used for the application of a great variety of tape thicknesses. Use of such a closed tape guide channel is made possible particularly by the drive device and guiding device for the frame parts according to the present invention, which make transverse motion of the frame parts unnecessary.

As can be seen in FIGS. 1 to 5, in the drive of frame parts 7, 8, in the direction of their curved centerlines, according to the present invention it is possible to arrange all machine parts, particularly the sealing unit 3, within the annular path of motion of the two frame parts 7, 8.

The sequences of motion for strapping a package 5 may be explained with the aid of the accompanying drawings. At first, frame parts 7, 8 are in their rest position below supporting surface 4 for the package (see FIG. 2). Thus the supporting table, which forms supporting surface 4 (not represented in FIG. 2), is free from obstacles, so that the package can be shifted on the supporting table as desired. However, it is alternatively possible to move one of frame parts 7, 8 upward by a specific distance, for example 10 cm, out of supporting surface 4, so that this frame part 7, 8 forms a stop for the package. As soon as a package 5 is placed on supporting surface 4, the two frame parts 7, 8 are moved upward by drive rollers 22, 23, out of supporting surface 4, until they assume the closed position shown in FIG. 1. In the open position (FIG. 2), the two semicircular frame parts 7, 8, situated in two planes displaced with respect to one another, lie essentially covered within the supporting frame of the machine. Portions 26, 27 for formation of the tape guide channel, each of which forms approximately one quarter of a circular ring, each extend over one-half of one of the two frame parts 7, 8.

Figure 3:
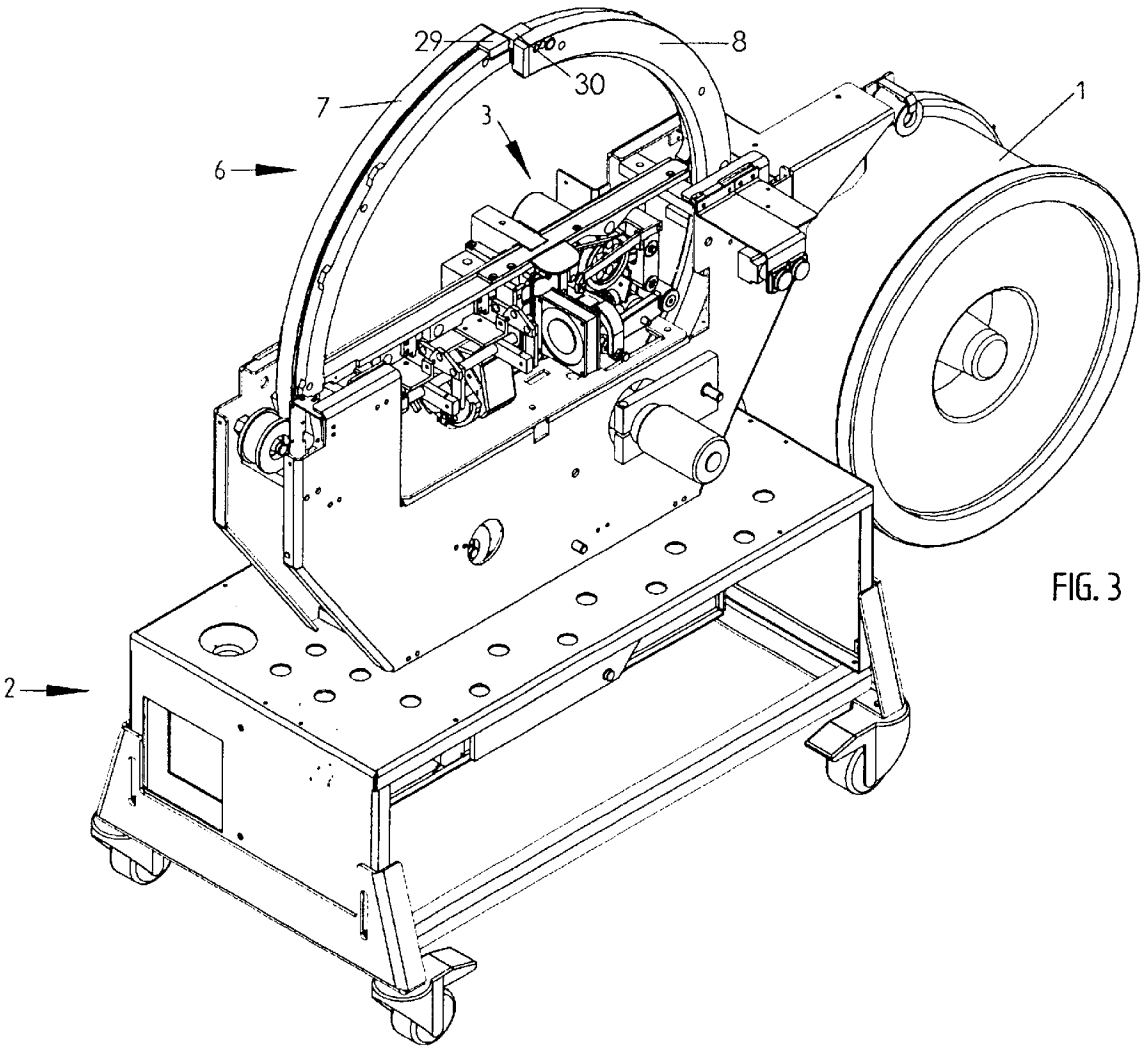
FIG. 3 shows a diagrammatic representation of the machine in the preceding figures with closed tape guide frame.

In the extended closed position of tape guide frame 6, which may be seen in FIGS. 1 and 3, the faces of portions 26, 27 rest against one another for formation of the tape guide frame. Means for alignment with one another of the faces of portions 26, 27 of the tape guide channel are arranged on frame parts 7, 8. These means consist of two aligning blocks 29, 30. The first aligning block 29 bears a centering pin 31. The second aligning block 30 has an essentially conical bore 32 for the accommodation of centering pin 31. The two aligning blocks 29,30 are fixed to the two frame parts 7,8 on the same side as the two tape guide channel portions 26,27 and radially outward thereof. Thus, the aligning blocks 29,30 lie in the same plane as the two tape guide channel portions 26,27, i.e. the strapping plane. The two aligning means ensure that frame parts 7, 8 and, hence, in the closed state (see FIG. 6), portions 26, 27 of the tape guide channel are in exact alignment with one another, so that the strapping tape can be carried through the semicircular tape guide channel free of resistance.

After passage of the strapping tape through the tape guide channel, the two portions 26, 27 of the tape guide channel are moved transverse with regard to frame parts 7, 8, so that a gap for drawing through the strapping tape is opened. Then the two frame parts 7, 8 may be moved back again below supporting surface 4 by electric motors 24, 25.

The guiding means, i.e., guide rollers 14 to 21, for the two frame parts 7, 8, are very simple and inexpensive to make as standard structural parts fastened to the supporting frame of the strapping machine. The drive of the two supporting frames 7, 8 by means of electric motors 24, 25 also represents an extremely simple, easily controllable and economical drive variant. In particular, it is possible, by individual control of electric motors 24, 25, to drive frame parts 7, 8 independently of one another. For example, electric motors 24, 25 may each incorporate sensors that interrupt a power supply to the electric motor when the driving force exceeds a predetermined level. Thus, for example, one of frame parts 7, 8, upon delivery of a new package 5, may be pushed several centimeters upward out of supporting surface 4, in order to form a stop for package 5.

The time for completion of a strapping of a package 5 may be reduced considerably by overlapping the various work steps. Thus, after opening of the tape guide channel (see FIG. 4) and contraction of loop 9 of the strapping tape, frame parts 7, 8 for formation of the tape guide channel may already be opened (FIG. 5) while welding unit 3 is still welding together the two ends of loop 9. For reasons of clarity, loop 9 of the strapping tape is shown in the figures at a great distance from package 5. In practice, loop 9 is tightened around package 5 before welding, so that it essentially sits tightly against package 5.

While the invention has been disclosed in connection with various embodiments, modifications thereon will be readily apparent to those skilled in the art. Accordingly, the spirit and scope of the invention is set forth in the following claims.

What is claimed is:

1. A device for strapping packages, comprising:

a tape supply for a strapping tape, a tape guide channel for passage of the strapping tape, and a sealing unit for sealing a loop formed by the strapping tape and surrounding the package, the tape guide channel being arranged on a frame which has two curved frame parts, which are movable out of a rest position below a supporting surface for the packages, into a closed position above the supporting surface and back;

wherein each frame part below the supporting surface is guided moveably along its curved centerline by at least one guiding device; and wherein each frame part is curved in the shape of at least a portion of an arc of a circle.

2. The device according to claim 1, wherein the guiding device for one of the frame parts has at least two guide-roller pairs, and the two guide rollers of one pair face one another and rest on the arc-shaped curved surfaces of said frame part.

3. The device according to claim 2, further comprising at least one drive roller disposed against a surface of at least one of the frame parts.

4. The device according to claim 3, wherein the at least one drive roller is driven by an electric motor.

5. The device according to claim 4, further comprising a sensor for detection and measurement of the driving force acting on the frame parts, the sensor transmitting an interrupt signal to a power supply attached to the electric motor of the drive device for the frame parts when the driving force exceeds a predetermined level.

6. The device according to claim 3, wherein the drive roller has a friction coating on at least a portion of its circumference.

7. The device according to claim 2, wherein the frame parts are arranged in two planes displaced with respect to one another in a direction perpendicular to a direction of motion of the frame parts, and a portion of a tape guide channel is fastened on adjacent faces of both of the frame parts disposed to face one another and disposed in essentially a single plane.

8. The device according to claim 7, wherein the tape guide channel portions are fastened to the frame parts to be moveable in a direction transverse to a strapping plane.

9. The device according to claim 7, further comprising means for alignment of the faces of both of the frame parts disposed to face one another, arranged near portions of the tape guide channel lying on one another in a closed position of the frame parts.

10. The device according to claim 9, wherein the means for alignment include a conical bore fastened to a first frame part and a tapered plug fastened to a second frame part.

11. The device according to claim 2, further comprising a sensor for detecting a closed position of the frame parts.

12. The device according to claim 11, further comprising a control device that releases a feed of the strapping tape when the sensor emits a signal representing the closed position of the frame parts.

13. The device according to claim 2, wherein the frame part comprises approximately one-half of a circular ring, and each part of the tape guide channel fastened to a frame part has the shape of one quarter of a circular ring.

14. The device according to claim 2, further comprising a supporting frame that has two facing cheeks and a bearing surface extending between the cheeks, while one frame part of the tape guide channel is movable fastened to each cheek, and the bearing surface supports the sealing unit.

15. A device for strapping packages, comprising:

a tape supply for a strapping tape, a tape guide channel for passage of the strapping tape, and a sealing unit for sealing a loop formed by the strapping tape and surrounding the package, the tape guide channel being arranged on a frame which has two curved frame parts, which are movable out of a rest position below a supporting surface for the packages, into a closed position above the supporting surface and back;

wherein each frame part below the supporting surface is guided moveably along its curved centerline by at least one guiding device; and wherein the guiding device for one of the frame parts has at least two guide-roller pairs, and the two guide rollers of one pair face one another and rest on the curved surfaces of said frame part.

16. The device according to claim 3, further comprising at least one drive roller disposed against a surface of at least one of the frame parts.

17. The device according to claim 15, wherein the at least one drive roller is driven by an electric motor.

18. The device according to claim 7, further comprising a sensor for detection and measurement of a driving force acting on the frame parts, the sensor transmitting an interrupt signal to a power supply attached to the electric motor of the drive device for the frame parts when the driving force exceeds a predetermined level.

19. The device according to claim 15, wherein the drive roller has a friction coating on at least a portion of its circumference.

20. The device according to claim 15, wherein the frame parts are arranged in two planes displaced with respect to one another in a direction perpendicular to a direction of motion of the frame parts, and a portion of a tape guide channel is fastened on adjacent faces of both of the frame parts disposed to face one another and disposed in essentially a single plane.

21. The device according to claim 20, wherein the tape guide channel portions are fastened to the frame parts to be moveable in a direction transverse to a strapping plane.

22. The device according to claim 20, further comprising means for alignment of the faces of both of the frame parts disposed to face one another, arranged near portions of the tape guide channel lying on one another in a closed position of the frame parts.

23. The device according to claim 15, wherein the means for alignment include a conical bore fastened to a first frame part and a tapered plug fastened to a second frame part.

24. The device according to claim 3, further comprising a supporting frame that has two facing cheeks and a bearing surface extending between the cheeks, while one frame part of the tape guide channel is movable fastened to each cheek, and the bearing surface supports the sealing unit.

25. A device for strapping packages, comprising:

a tape supply for a strapping tape, a tape guide channel for passage of the strapping tape, and a sealing unit for sealing a loop formed by the strapping tape and surrounding the package, the tape guide channel being arranged on a frame which has two curved frame parts, which are movable out of a rest position below a supporting surface for the packages, into a closed position above the supporting surface and back;

wherein each frame part below the supporting surface is guided moveably along its curved centerline by at least one guiding device; and a sensor for detecting a closed position of the frame parts.

26. The device according to claim 25, further comprising a control device that releases a feed of the strapping tape when the sensor emits a signal representing the closed position of the frame parts.

27. A device for strapping packages, comprising:

a tape supply, and a tape guide channel disposed upon a frame having at least two curved frame parts movably disposed from a rest position below a supporting surface for the packages to a closed position above the supporting surface, wherein each frame part is guided moveably along its curved centerline by at least one guiding device disposed below the supporting surface;

wherein the guiding device for one of the frame parts has at least two guide-roller pairs, and the two guide rollers of one pair face one another and rest on the curved surfaces of said frame part.

28. The device of claim 27, further comprising a sealing unit that seals a loop formed to surround a package.

29. A device for strapping packages, comprising:

a tape supply, and a tape guide channel disposed upon a frame having at least two curved frame parts movably disposed from a rest position below a supporting surface for the packages to a closed position above the supporting surface, wherein each frame part is guided moveably along its curved centerline by at least one guiding device disposed below the supporting surface;

wherein each frame part is curved in the shape of at least a portion of an arc of a circle, and wherein said at least one guiding device includes at least one guide roller that guides at least one frame part.

30. The device of claim 29, further comprising a sealing unit that seals a loop formed to surround a package.

* * * * *

UNITED STATES PATENT AND TRADEMARK OFFICE

CERTIFICATE OF CORRECTION

PATENT NO. : 6,786,026 B2
DATED : September 7, 2004
INVENTOR(S) : Lorenz Helmrich It is certified that error appears in the above-identified patent and that said Letters Patent is hereby corrected as shown below:

Column 9,
Lines 35, 53, 59 and 63, the dependency reference to “claim 2” is corrected to read -- claim 1 --.

Column 10,
Line 17, the dependency reference to “claim 3” is corrected to read -- claim 15 --.
Line 22, the dependency reference to “claim 7” is corrected to read -- claim 17 --.
Line 28, the dependency reference to “claim 15” is corrected to read -- claim 16 --.
Line 46, the dependency reference to “claim 15” is corrected to read -- claim 22 --.
Line 49, the dependency reference to “claim 3” is corrected to read -- claim 15 --.

Signed and Sealed this

First Day of February, 2005

JON W. DUDAS
*Director of the United States Patent and Trademark Office*